US005511626A

United States Patent [19]

Steen

[11] Patent Number: 5,511,626

[45] Date of Patent: Apr. 30, 1996

[54] HYDRAULICALLY OPERATED SUBSOIL DISPLACEMENT APPARATUS

[75] Inventor: Henrik Steen, Hjallerup, Denmark

[73] Assignee: Breakers A/S, Aalborg, Denmark

[21] Appl. No.: 370,880

[22] Filed: Jan. 10, 1995

[30] Foreign Application Priority Data

Jan. 11, 1994 [DK] Denmark ..... 94 00012

[51] Int. Cl.[6] ..... E21B 4/14

[52] U.S. Cl. ..... 175/19; 175/296; 173/91; 173/126

[58] Field of Search ..... 175/19, 296, 414, 175/92, 94; 173/91, 127, 138

[56] References Cited

U.S. PATENT DOCUMENTS

| | | | |
|---|---|---|---|
| 3,796,271 | 3/1974 | Amtsberg | 173/102 |
| 3,903,972 | 9/1975 | Bouyoucos et al. | 173/134 |
| 4,144,941 | 3/1979 | Ritter | 175/19 |
| 4,596,292 | 6/1986 | Crover | 175/19 |
| 4,953,626 | 9/1990 | Püttmann et al. | 175/19 X |
| 5,056,608 | 10/1991 | Hemmings | 173/91 X |
| 5,096,000 | 3/1992 | Hesse | 175/296 X |
| 5,318,135 | 6/1994 | Kayes | 175/19 |
| 5,337,837 | 8/1994 | Wentworth et al. | 175/19 |

*Primary Examiner*—Frank S. Tsay
*Attorney, Agent, or Firm*—Lee, Mann, Smith, McWilliams, Sweeney & Ohlson

[57] ABSTRACT

A hydraulically operated mole has a reciprocating hammer operated by means of an impact mechanism which may be readjusted from forward to backward wiring by displacement of a valve tube secured to a piston near the rear end of the apparatus. The piston is activated by the switching of oil supply and withdrawal respectively to the tank between two pipeline stubs at the rear end of the apparatus. The fluid connections between the stubs and the piston are completely separated as regards the flow. As a result, complicated and vulnerable valve elements used in known hydraulic moles are avoided.

2 Claims, 8 Drawing Sheets

HYDRAULICALLY OPERATED SUBSOIL DISPLACEMENT APPARATUS

STATE OF THE ART

The invention relates to a hydraulically operated subsoil displacement apparatus comprising a shell which surrounds a hydraulic impact mechanism with a linearly slidable hammer. Under the action of hydraulic oil, which is supplied under pressure by a hydraulic hose and withdrawn without pressure by another hydraulic hose, the hammer may implement a reciprocating movement with blows against a forward or rearward impact point at the inside of the apparatus. Change of the impact point may take place by axial displacement of a tube extending centrally and axially into the hammer where the supply of oil may take place through an arbitrary hydraulic hose by working a valve where the connection to the supply of oil under pressure and the connection to withdrawal to a tank are switched between the pipes. In the apparatus there is a hose union for each hose where each hose union is connected to an oil duct which can discharge oil on opposite sides of a piston secured to the tube. The piston is provided with at least one oil duct which gives passage to the interior of the tube.

Such an apparatus is known from U.S. Pat. No. 4,596,292. The tube and the piston are one piece, and the tube disembogues into a chamber on the side of the piston opposite the tube. Ducts emanate from this chamber to both hose unions, and therefore nonreturn valves with loose balls are placed at the openings between the ducts and the chamber so that oil under pressure is not pressed into the chamber when said chamber must function as pipe connection to tank. The ball valves in the said construction are sensitive to pollution in the oil and moreover they are a complicated and therefore costly element in the construction.

Apparatus of this kind are used to bore holes for pulling of cables and pipelines through the soil in places where it is particularly difficult or expensive to dig up, for instance by boring under roads. Apparatus of this kind and similar pneumatically operated apparatus may also be used when renovating sewage pipes or cast iron where the existing tube is broken to pieces and a new tube is drawn behind the apparatus.

SUMMARY OF THE INVENTION

The innovative feature of the apparatus according to the invention is that the piston on the end opposite the tube is closed and that the two fluid connections intended for oil, which are formed by more adjoining ducts and cavities in the apparatus and in the piston for the supply and withdrawal of oil, in the part from the respective hose unions and to the piston are completely separated as regards the flow between the hose unions and the interior of the piston.

In so doing it is possible to keep the part of the oil flow without pressure and the part of the oil flow loaded with pressure separated without using special valve elements for the use of swithching between the impact points in order to change the direction of motion of the apparatus. The construction is simpler and less sensitive to pollution in the hydraulic oil.

In a certain embodiment of the invention the closed end of the piston opposite the tube is provided with a tubular extension with a smaller diameter than the piston, and in which there is provided a slidable plug which separates a gas-proof chamber farthest from the piston with an oil-filled chamber nearest to the piston, said oil-filled chamber being connected to the other duct system of the apparatus.

In so doing the closed side of the piston is utilized to place a gas accumulator which can absorb surge in the oil. Compared to the known art of such apparatus the gas accumulator according to the invention is simpler and space-saving as it is placed somewhere in the apparatus where room can be made without changing other parts in the apparatus.

BRIEF DESCRIPTION OF THE DRAWING

A preferred embodiment of the invention will now be described in more detail with reference to the drawing, where.

DESCRIPTION OF EMBODIMENT

Figure 1:
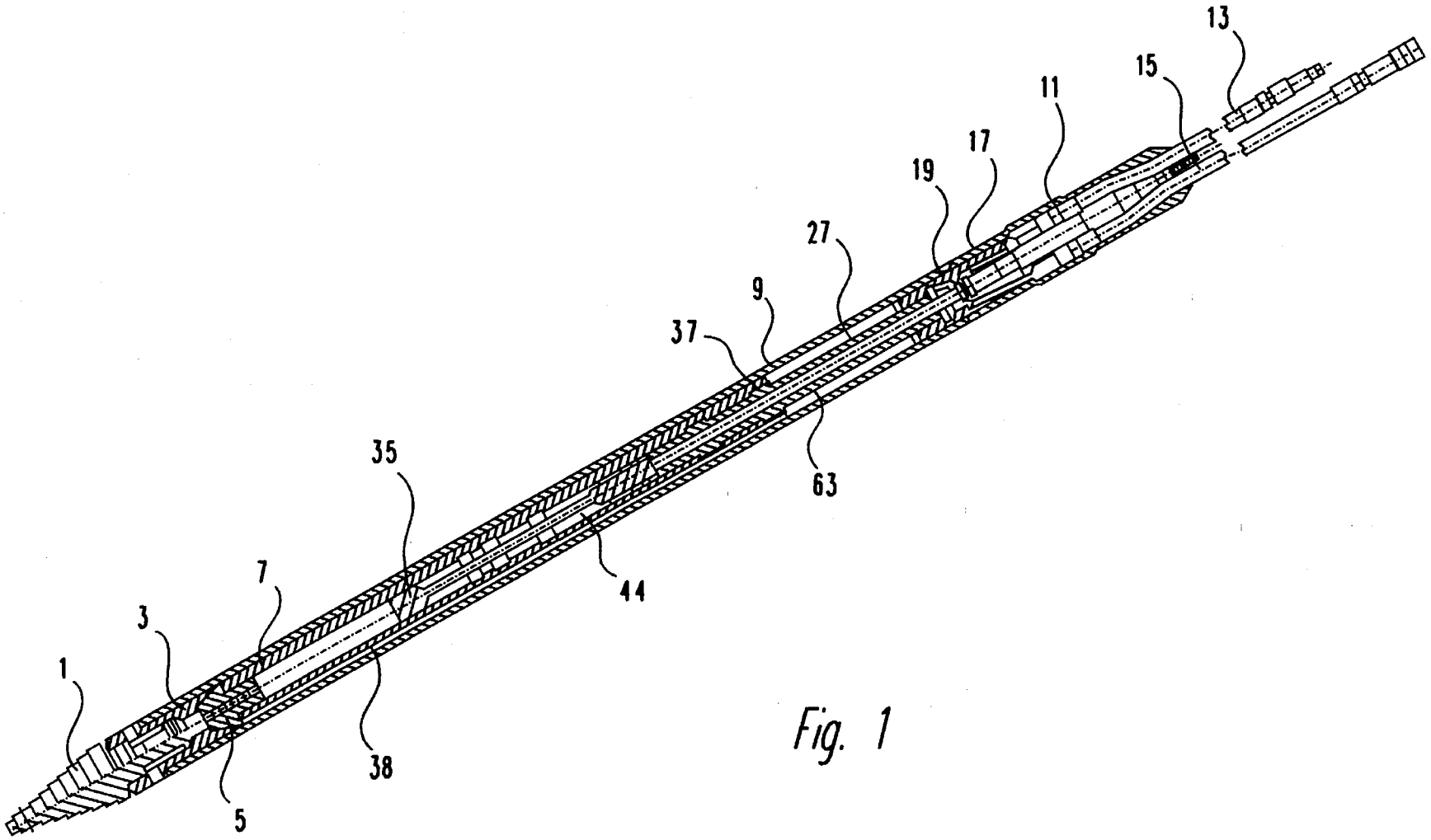
FIG. 1 shows a longitudinal section through an earth penetrating tool according to the invention.

It is preferred that an earth penetrating tool according to the invention and designed for the drawing of cables or simply for the making of horizontal underground holes without digging-up is configured as shown in FIG. 1.

At the front of the device, seen in the normal direction of travel of the device while penetrating solid soil, there is a demolishing head 1 or a chisel of a known kind, and which may be impacted by blows from the front part 5 of a hammer 7 through an anvil 3.

Along most of its length the device is surrounded with a shell in the form of a tube, in which the hammer 7 may slide controlled by guidings, which are not shown. At the back of the device, seen in the normal direction of travel, there is a rear shell 11 having a somewhat larger outside bore than the shell 9, and having an opening at the back for two hydraulic hose unions or pipe stubs 13 and 15 for the admission and withdrawal of oil. A rubber packing 14 keeps the stubs 13, 15 in position with relation to the rear shell 11.

Figure 2:
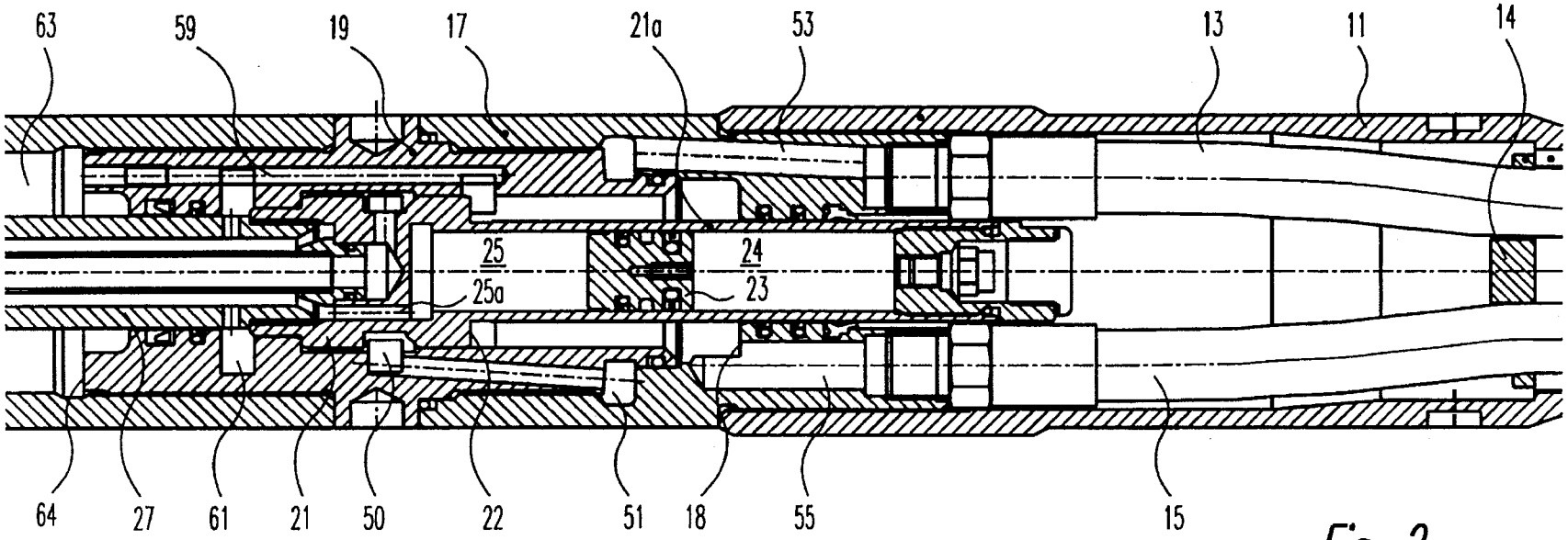
FIG. 2 shows an enlarged detail of a portion of FIG. 1 and showing the hydraulic reverse mechanism in the forwardly propelling position.
Figure 5:
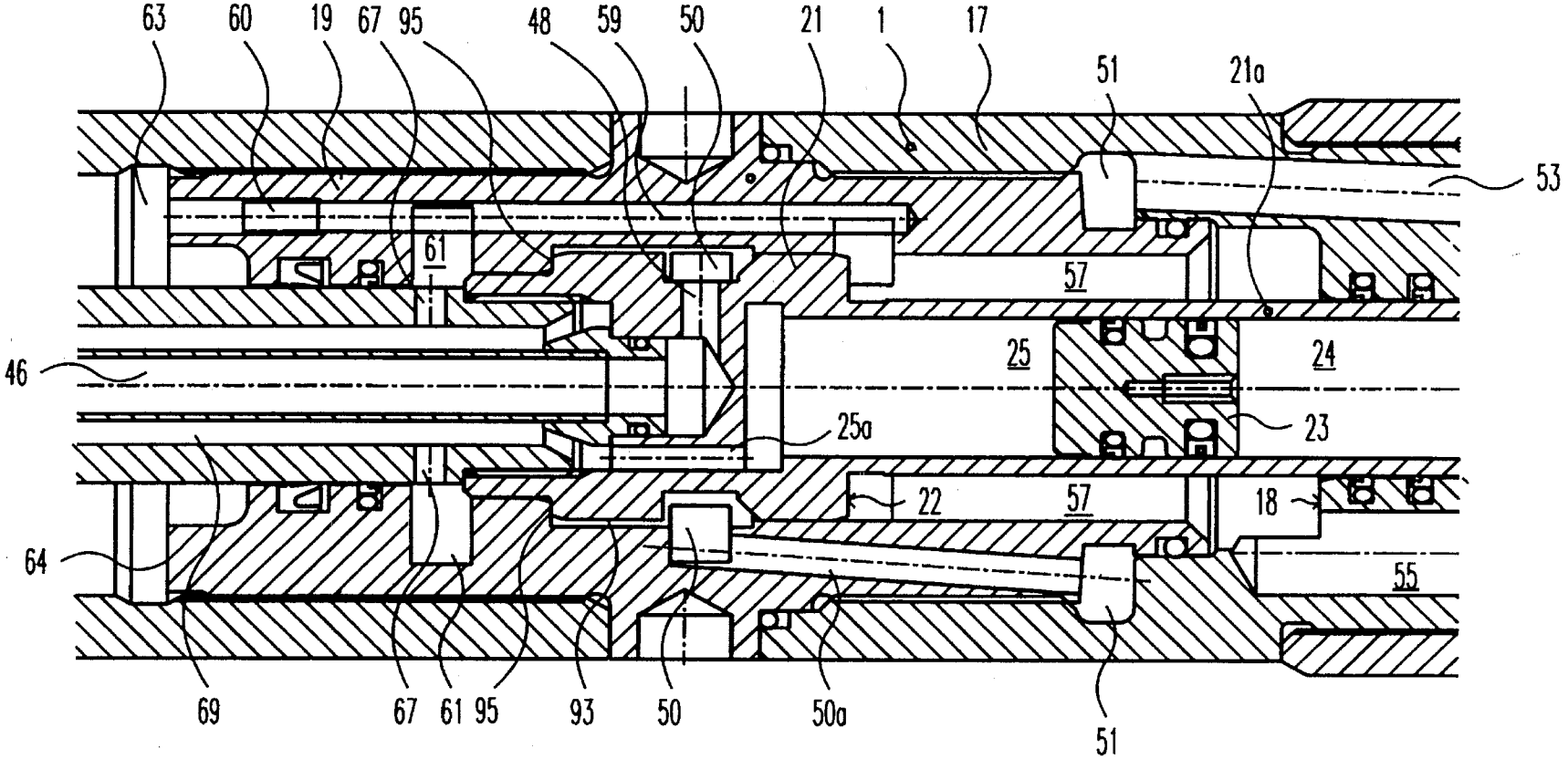
FIG. 5 shows the same as FIG. 2, but further enlarged.

As shown in FIGS. 2 and 5 there is a spacer 17 between the rear shell 11 and the shell 9 which is secured threadably to the rear shell 11 and to the reversing housing 19. The latter 19 is secured threadably to the shell 9. Inside the reversing housing 19 there is a slidable piston 21, which is shown in its front position in the figures, and which is extended with a gas-pressure accumulator 21a at the backside.

The accumulator 21*a* has a movable plug 23 which separates an air-filled space 24 from an oil-filled space 25. The oil-filled space 25 is connected with the hydraulic system through a duct 25*a* by means of which differences in the amount of oil during operation may be absorbed. By this embodiment of the accumulator a simpler construction is obtained. By employment in the smallest dimensions of the device the accumulator 21*a* may in certain cases be left out as pressure peaks may be absorbed up by the inherent elasticity of the connected hydraulic hoses.

The piston 21 is secured to one of the ends of a tube 27 which at its other end is secured to a valve housing 29. The valve housing 29 contains a slidable valve body 31 and is at the end opposite to the tube 27 connected to a lever 33 which has a head 35 provided with seals 35*a* abutting against the inside of the hollow hammer 7 at a diameter with the size D1. The outside of the valve housing 29 also connects to the inside of the hammer 7, but at a diameter with the size D2, which is larger than D1.

At the rear end of the hammer there is a sealing sleeve 37 which seals the space between the tube 27 and the hammer 7. The sleeve 37 connects to the tube 27 at a diameter with the size D3, which is larger than D1 and less than D2.

Moreover, the device is provided with dynamic and, if necessary, static seals between the parts in order to maintain differential pressure during operation. If no sealing elements are shown in the drawing, sealing has been created by interference fit between the parts.

In order to allow passage of air during the reciprocating movement of the hammer, there is a slit 38 in the outside of the hammer. The inner side of the hammer is provided with sparings 39,40,41 and 42 which provide for passage of hydraulic oil as described below.

The valve housing 29 is hollow and provided with different ducts which give access to the space 44 around the lever 33, to the sparings 39–41, to openings in the valve body 31 and to an inner tube 46 which is inside and concentric to the tube 27. The inner tube 46 gives access to the interior of the piston 21, and from there further by a side duct 48, which in the shown position of the piston is connected to an annular duct 50 in the reversing housing 19. From the duct 50 a connecting duct 50*a* forms access to another annular duct 51 which is connected to the stub 13 via a duct 53.

In the shown position of the piston 21 there is a further connection from the stub 15 through a duct 55 to a chamber 57 which surrounds the accumulator 21*a* and from which 57 there is a duct 59 connected to an annular duct 61 around the tube 27 and to a space 63 which is between the rear end 65 of the hammer 7 and the reversing housing 19. A threaded plug 60 seals the duct 59.

Figure 6:
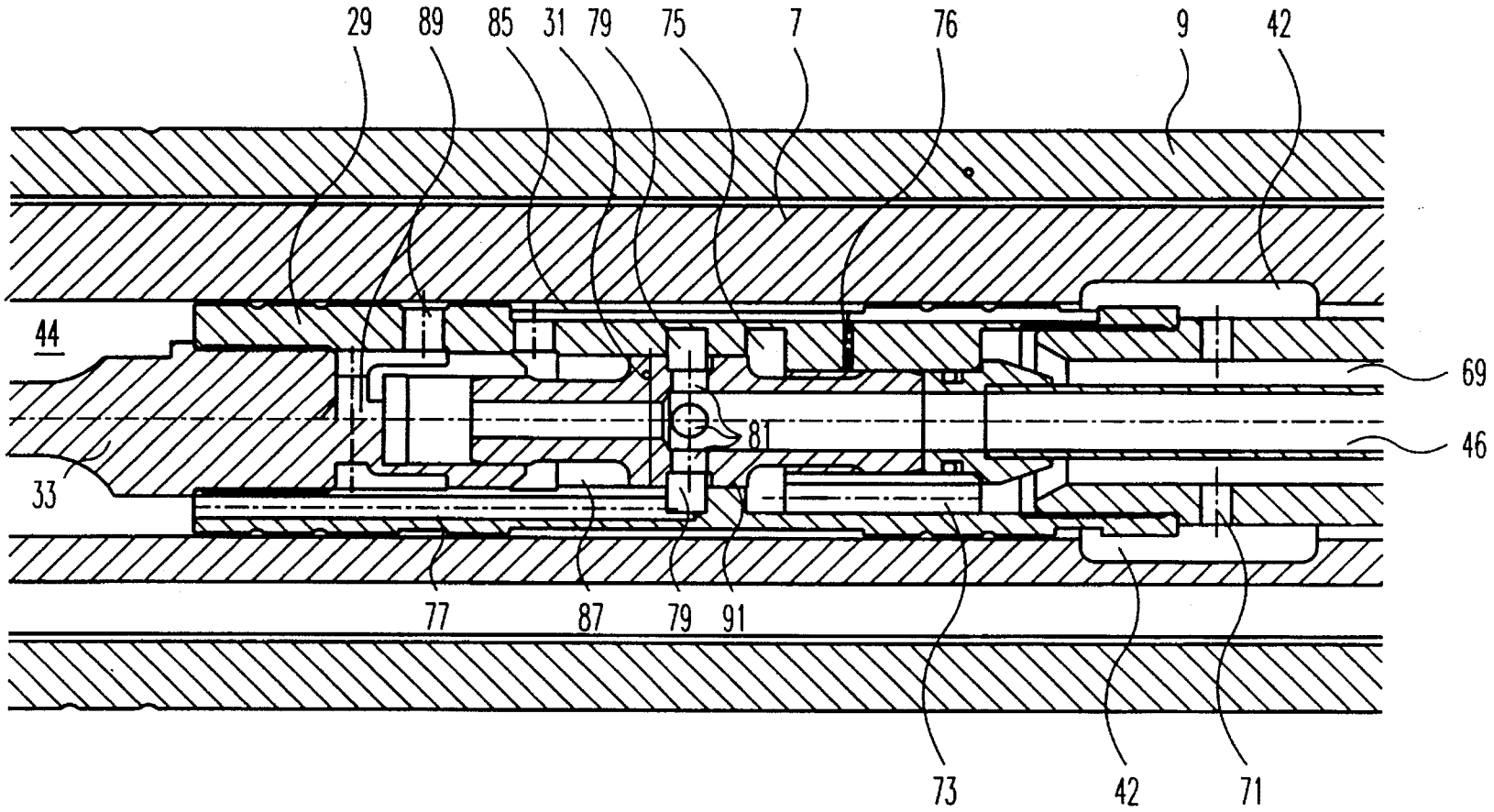
FIG. 6 shows the same as FIG. 3, but further enlarged.

When the piston 21 is in its foremost position as shown, there are laterally facing openings 67 in the tube 27, said openings 67 giving access to a space 69 between the inner tube 46 and the tube 27. From the space 69 there is access to the outer side of the tube 27 via ducts 71 and to a duct 73 inside the valve housing 29. The duct 73 leads to an annular duct 75 which surrounds the valve body 31. As shown in FIG. 6 it is shut off apart from a leakage hole 76 to the outer side of the housing.

The valve housing 29 has a longitudinal bore 77 forming a connection between the space 44 and an annular duct 79. In the shown position of the valve body, four bores 81 form a connection between an inner space 83 in the valve body 31 and the duct 79. On the outside of the valve housing 29 there is a longitudinal slit 85 which is connected to a space 87 of variable size around the body 31. Finally there are connecting ducts 89 from the end of the valve body 31 to the outer side of the housing.

In the position shown in the drawing, the reversing mechanism is shown in the position that causes normal propulsion for the mole, that means blows in the direction of the demolishing head 1. It will be so when there is an oil pressure on the stub 15 while the stub 13 is without pressure and connected to tank. Control of the pressure is effected by means of a hydraulic valve block, which is not shown.

Figure 3:
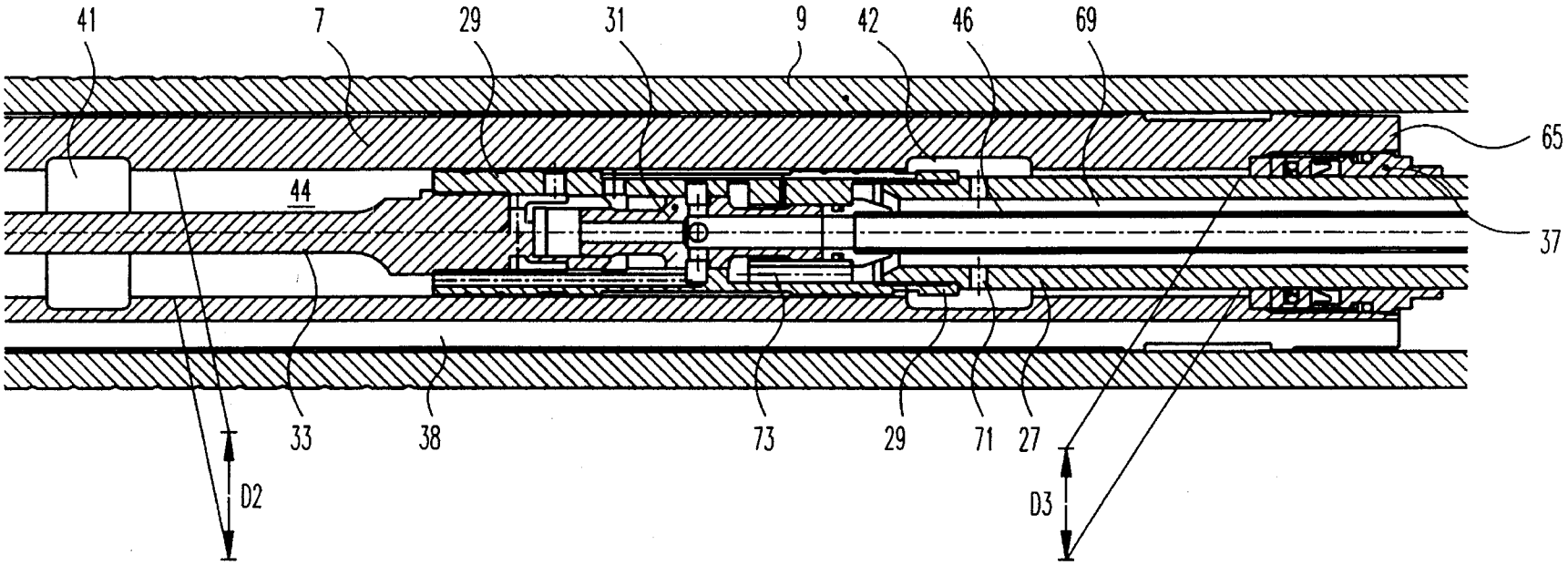
FIG. 3 shows an enlarged detail of a portion of FIG. 1 showing the rear part of the hammer and the blow mechanism.
Figure 4:
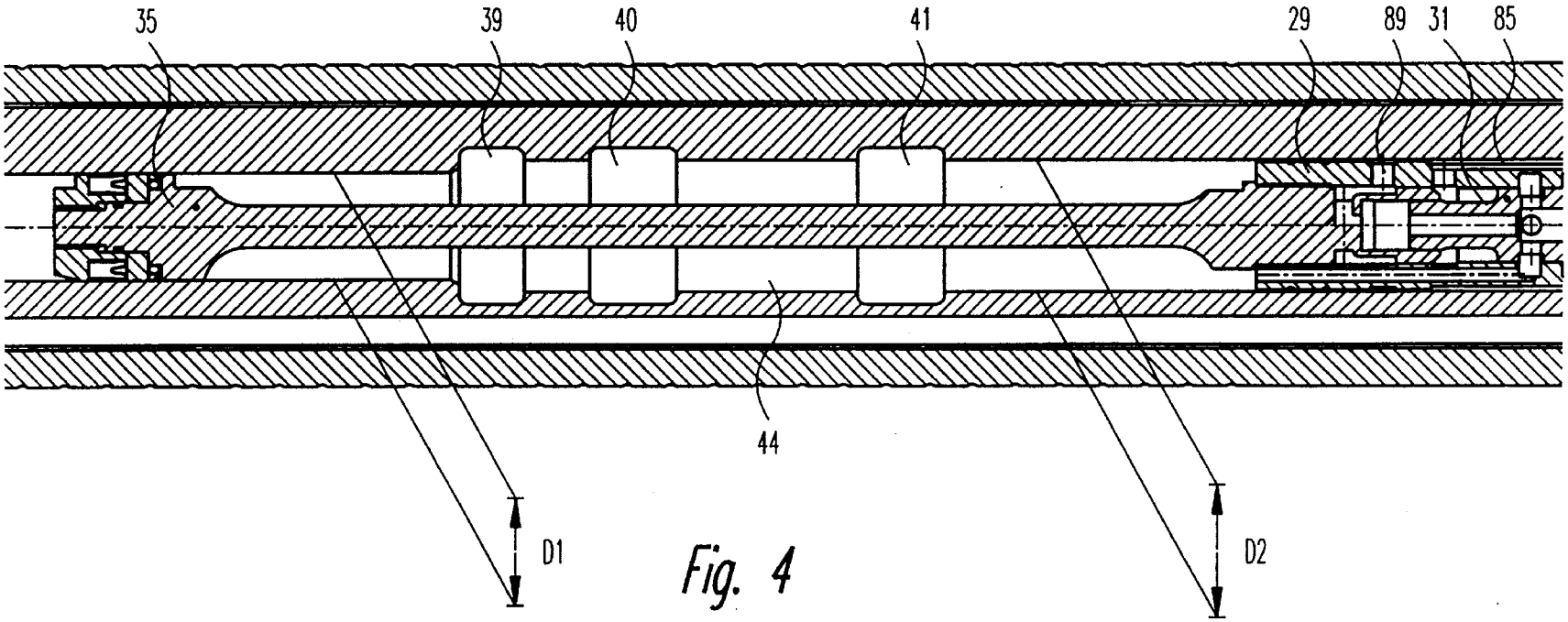
FIG. 4 shows an enlarged detail of a portion of FIG. 1 showing the middle part of the hammer.

The oil pressure from the hose 15 is then transmitted through the ducts 55,57,59,61,67, through the space 69 in which the pressure is led partly through the duct 73 to the annular duct 75 and partly through ducts 71 via the sparing 42 and the slit 85 to the closed space 87. Because the net area the resulting pressure exerting in the space 87 is larger than the net area for the resulting pressure in the space (the duct) 75, the valve body 31 will be forced to the right in the shown position in FIGS. 3 and 6. As the oil in the space 44 is at the same time without pressure because the space 44 is connected via the connections 77, 79,81,46,48,50,50*a*,51 and 53 to the tank in which the oil may run away from the space 44, a resulting force against the sleeve 37 will arise because of the slot with the diametrical difference D2–D3 between the tube 27 and the hammer 7. The force will accelerate the hammer 7 to the right, which means to the rear towards the reversing housing 19.

When the hammer 7 has moved a little the sparing 42 will no longer form a connection between the holes 71, which means the delivery side, to the slit 85 and also the space 87. As the oil in the space 87 will then be shut off the valve body will be unable to move. During the continuous movement of the hammer the sparing 41 will, however, form a connection between the space 87 via the slit 85 to the interior of the body which via the tube 46 is connected to the tank and which is without pressure. Consequently, the pressure in the room 75 will change the valve body 31 to the left in the drawing.

By the change the knob 91 of the body 31 passes the duct 79, and a connection is now formed between the space 75 and the duct 79 so that the static oil pressure is led through the bore 77 to the space 44. When the oil pressure is the same in the space 44 and in the slot between hammer 7 and tube 27 the greater value of D2–D1 than D2–D3 will cause a resulting force on the hammer 7 in the opposite direction, which means to the left in the drawing. The hammer will accordingly be accelerated to impact on the anvil 3. In the top position during the impact the hammer 7 will again be in the initial position shown in the drawing, and the valve body 31 will return to the initial position because of the sparing 42.

By means of the shown construction it is possible to set the device in forward motion at an oil pressure of 60 bar or less. At the maximum oil pressure of 150 bar and at suitable dimensioning of the length of stroke the hammer will have an impact frequency of about 6–7 hertz. Contrary to the known art the device according to the invention may be set to start at a low oil pressure and may be set to work at a lower impact frequency than normal which may be desirable under certain soil conditions.

Figure 7:
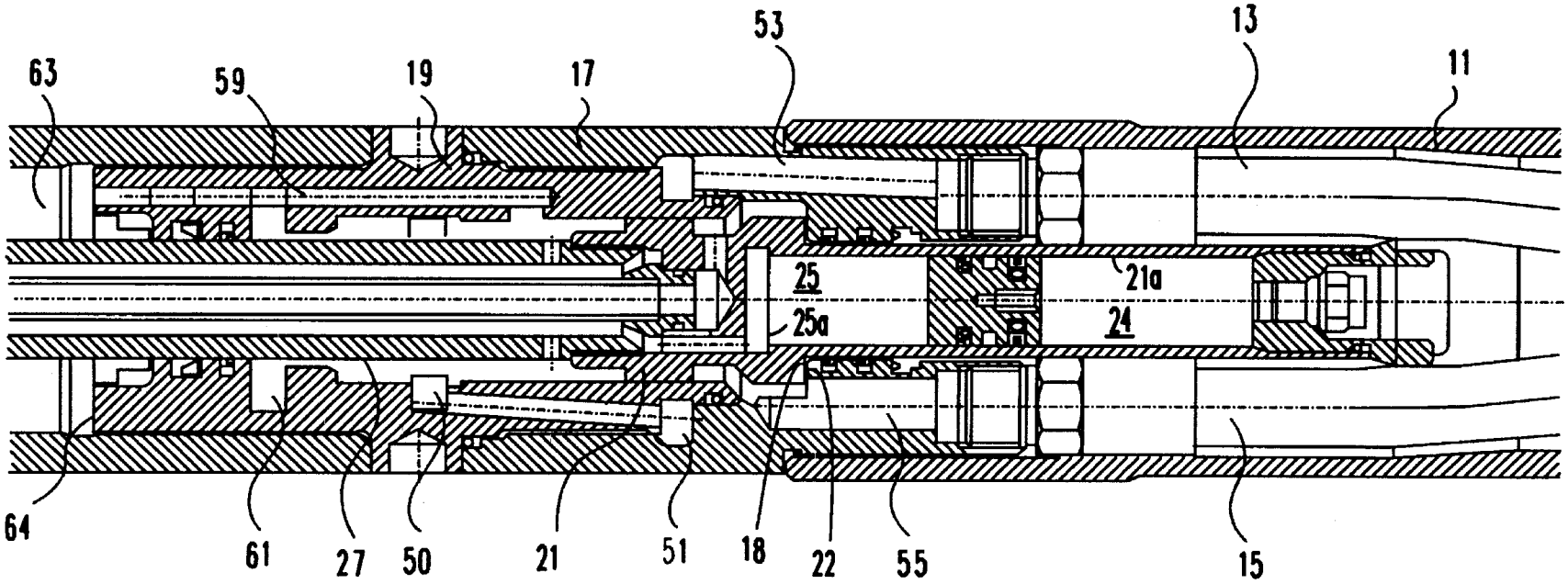
FIG. 7 shows the same as FIG. 2, but with the mechanism in the rearwardly propelling position.
Figure 8:
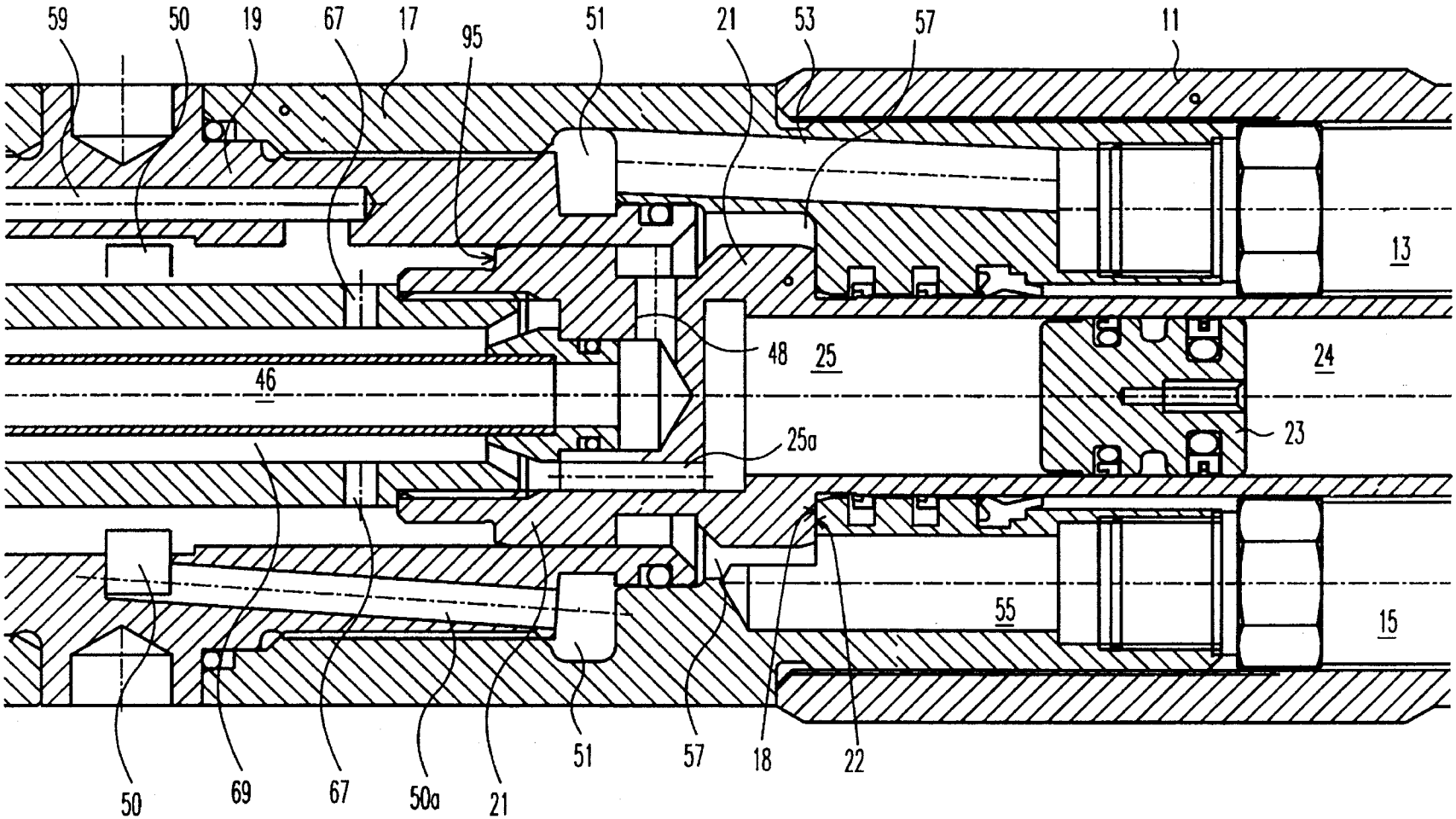
FIG. 8 shows the same as FIG. 5, but with the mechanism in the rearwardly propelling position.

The device may operate backwards, which means that the rear end 65 of the hammer strikes against a rear anvil 64 on the reversing housing 19, and this is done by means of the piston 21 which is being shifted till its recess 22 abuts on a sleeve 18 on the spacer 17, as shown in FIGS. 7 and 8. Thereby tube 27, valve housing 29 and lever 33 are shifted at the same time.

By means of the valve control, which is not shown, pressure is put on the stub 13 while the stub 15 is connected to the tank and becomes pressureless. The pressure is transmitted through the ducts 53,51,50*a* and 50 by means of which a pressure is also created in a slot 93 between piston 21 and reversing housing 19. As at the same time there is no pressure in the space 57, a resulting force will be created in a sleeve 95 adjacent to the housing 19 on the piston, said force forcing the piston 21 backwards. During the passage backwards the duct 48 will first be shut off towards the delivery side 50 and later in the bottom position be opened towards the tank side at the duct 55. In the bottom position the ducts 67 will be connected to the delivery side at the duct 50,50*a* and 51. Thereby the same pressure situation arises as in the duct 69 and in the inner tube 46, only the parts 21,27,29 and 33 are being shifted. Thereby the hammer 7 is forced to move its impact motion accordingly because of the sparings 41 and 42.

Other kinds of subsoil penetrating devices may be possible within the scope of the claims, for instance for breaking and renovation of sewage pipes and cast-iron pipes without excavation.

What I claim is:

1. A hydraulically operated subsoil displacement apparatus comprising a shell which surrounds a hydraulic impact mechanism with a linearly slidable hammer, in which under the action of hydraulic oil supplied from a supply of oil under pressure by a first hydraulic hose and withdrawn pressurelessly by a second hydraulic hose to a tank, reciprocating movement of said hammer is created with blows against a forward or rear impact point inside the apparatus, and in which change of the impact point is effected by axial displacement of a tube which extends centrally and axially into the hammer, in which pressurized oil is supplied through the first hydraulic hose by a valve connected to the supply of oil under pressure and the second hydraulic hose connected to the tank, said valve being formed to reverse connections of the first and second hydraulic hoses, the apparatus having a hose union for each hose where each hose union is connected to an oil duct connected to discharge oil to one side of a piston secured to the tube, the piston having at least one oil duct connected to the interior of the tube, the piston being closed at an end opposite the tube and the apparatus having two fluid conduits for oil which are formed by a series of adjoining ducts and cavities in the apparatus and in the piston for the supply and withdrawal of oil, the two fluid conduits being completely separate in the apparatus.

2. A displacement apparatus according to claim 1, wherein the end of the piston opposite the tube is provided with a tubular extension having a smaller diameter than the piston, and including a slideable plug which separates a gastight chamber farthest from the piston from an oil-filled chamber nearest to the piston, said oil-filled chamber being connected to said fluid conduits.

* * * * *